US012036437B2

(12) United States Patent
Sharp

(10) Patent No.: US 12,036,437 B2
(45) Date of Patent: Jul. 16, 2024

(54) DOOR FRAME EXERCISE SYSTEM

(71) Applicant: Kidstrong, Inc., Frisco, TX (US)

(72) Inventor: Matthew Sharp, Frisco, TX (US)

(73) Assignee: KIDSTRONG, INC., Frisco, TX (US)

( * ) Notice: Subject to any disclaimer, the term of this patent is extended or adjusted under 35 U.S.C. 154(b) by 105 days.

(21) Appl. No.: 17/501,442

(22) Filed: Oct. 14, 2021

(65) Prior Publication Data

US 2022/0080252 A1 Mar. 17, 2022

Related U.S. Application Data

(63) Continuation-in-part of application No. 17/467,675, filed on Sep. 7, 2021, now abandoned.

(60) Provisional application No. 63/077,318, filed on Sep. 11, 2020.

(51) Int. Cl.

| | |
|---|---|
| ***A63B 21/16*** | (2006.01) |
| ***A63B 23/035*** | (2006.01) |
| ***A63B 23/12*** | (2006.01) |

(52) U.S. Cl.

CPC ..... *A63B 21/1627* (2013.01); *A63B 23/0355* (2013.01); *A63B 23/1218* (2013.01)

(58) Field of Classification Search

CPC ... A63B 1/00; A63B 21/1627; A63B 21/1636; A63B 21/1645; A63B 21/1654; A63B 21/1663; A63B 21/4033; A63B 21/4035; A63B 23/0355; A63B 23/1218

See application file for complete search history.

(56) References Cited

U.S. PATENT DOCUMENTS

| | | | | |
|---|---|---|---|---|
| 3,342,484 | A * | 9/1967 | Christensen | A63B 1/005 482/40 |
| 4,772,011 | A * | 9/1988 | Guridi | A63B 21/1627 482/40 |
| 5,240,460 | A * | 8/1993 | Tighe | A63G 21/00 248/200.1 |
| 6,267,711 | B1 * | 7/2001 | Hinds | A63B 21/1663 482/904 |
| 11,389,683 | B2 * | 7/2022 | McCalester | A63B 1/005 |

* cited by examiner

*Primary Examiner* — Megan Anderson

(74) *Attorney, Agent, or Firm* — Bennet K. Langlotz; Langlotz Patent & Trademark Works, LLC

(57) ABSTRACT

An exercise apparatus for attachment and use within a door frame includes a pair of elongated frame elements with each having apertures configured to receive various types of cross bars. The frame elements are designed to be secured to vertical portions of a door frame without interfering with passing through the doorway or closing the door. A cross bar having a length greater than the door width is configured to be received within corresponding apertures among the frame elements. A cross bar has a retractable spring pin protruding from the bar so that the spring pin may engage a frame element to limit axial excursion of the bar. Two such spring pins may be included in the bar, so that with the frame elements including apertures having pin-receiving pockets, one type of bar may rotate freely while another type of bar is prevented from rotation.

18 Claims, 4 Drawing Sheets

DETAIL "A"

B - B

B - B

DETAIL "D"

C - C

C - C

DOOR FRAME EXERCISE SYSTEM

CROSS-REFERENCE TO RELATED APPLICATIONS

This application is a Continuation-in-Part of U.S. patent application Ser. No. 17/467,675 filed on Sep. 7, 2021, entitled "INFINITY TRAINING SYSTEM," which claims the benefit of U.S. Provisional Patent Application No. 63/077,318 filed on Sep. 11, 2020, entitled "KIDSTRONG INFINITY TRAINING SYSTEM," which are hereby incorporated by reference in their entirety for all that is taught and disclosed therein.

FIELD OF THE INVENTION

The present invention primarily relates to home exercise systems and equipment with various features and accessories for use by adults and children.

BACKGROUND AND SUMMARY

Play and exercise equipment for the home must withstand dynamic forces such as from the mass in motion of a child swinging, to that of full-sized adults performing pull-ups and gymnastic maneuvers. Door frames are convenient structures which are typically strong enough to support and withstand these forces, and so many sorts of exercise kits and activity sets are designed to attach to a door frame, whether temporarily or somewhat permanently. Unfortunately, installing exercise equipment at a door threshold often interferes with the primary function of the door, which is to allow passage through a wall.

A corollary problem occurs when the installed components interfere with or prevent a door from being closed. In this case the other functions of the door, such as visual privacy, or the exclusion of passage at times for sounds, persons, pets, or unwanted animals or insects is compromised.

The above disadvantages are addressed by an exercise apparatus comprising a pair of brackets which attach to the vertical jambs of a door frame at sites which do not interfere with a door closing and coming to rest against its stop elements, which are integral to the jambs and the lintel of the door frame. The brackets are elongated frame elements with each frame having a set of apertures which may receive one or more cross bars for doing exercises such as pull-ups or other gymnastics, or may receive other exercise or play accessories for children such as a swing, pull-up rings, or a rope ladder. The cross bars are long enough to pass through and beyond holes in the spaced-apart brackets.

DETAILED DESCRIPTION OF PREFERRED EMBODIMENTS

Exercise systems having cross bars and support brackets which are designed to be installed and used in door frames offer the convenience of exercising at home anytime but present several disadvantages. Safe installation may be time consuming and require advanced construction skills, tools, and installation techniques beyond the range or interest of typical home residents, and the greater the complexity of installation usually translates into inconvenience in uninstalling should a user wish to relocate the apparatus to another door or another building.

The invention disclosed herein is convenient to install and uninstall and does not leave behind great or unreasonable damage to door frames when it is removed. The exercise system includes two brackets affixed to a door frame, which each have a set of apertures so that the two sets may be registered with each other by height so as to receive a cross bar and support it horizontally at any of a number of desired heights.

According to some embodiments within the scope of the invention, a cross bar includes at least one transverse pin which is compressible so as to retract to within the outer diameter defined by the cross bar, and another transverse pin which may also be retractable or non-retractable so as to compressibly extend or rigidly protrude beyond the outer diameter of the bar. Alternatively, the non-retractable feature may be a flange at an end of the bar, or a ring, a partial ring, or a fixed protrusion located at or near an end of the bar. In this specification a "spring pin" is a device or feature with a compressible element that protrudes radially beyond an outer diameter of a cross bar and may be pushed radially inward so that it no longer protrudes beyond the outer diameter of the cross bar.

When the two brackets are installed onto the two jambs of a door frame, they will be spaced apart by a distance which is about the same distance as the width of the door. A cross bar in accordance with the invention is preferably longer than this spacing distance so that when installed it may rest substantially horizontally while spanning the width between the two brackets installed in the door frame and passing through both brackets to extend beyond the brackets to eliminate the chance that axial excursion of the bar during exercise or play might allow one end of the cross bar to slip out of the bracket and fall.

Figure 1:
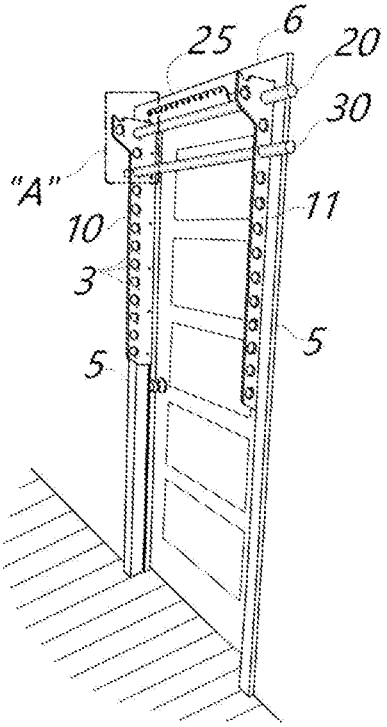
FIG. 1 shows an oblique, front left perspective view of components of an exercise system in accordance with the invention installed in door frame, with the door able to be closed. A detail portion "A" of this figure is shown in FIG. 2.
Figure 2:
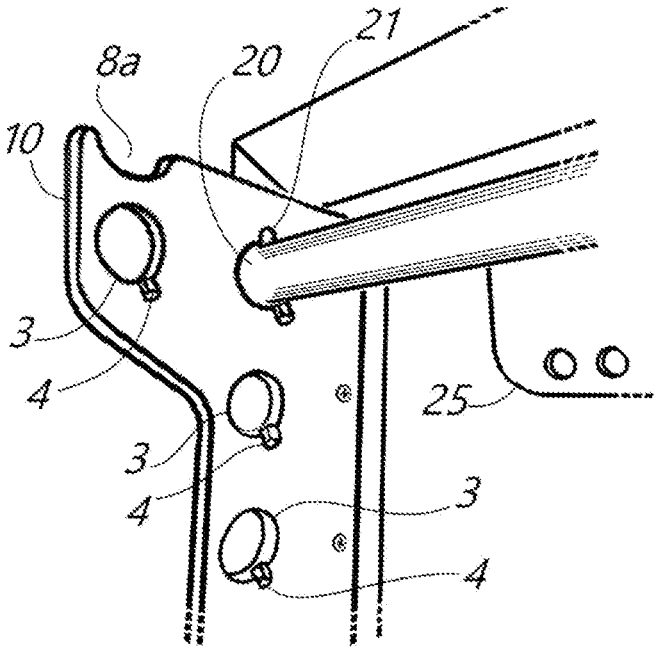
FIG. 2 shows an enlargement of the bounded portion "A" of FIG. 1.

Referring now to the figures, FIG. 1 shows an oblique, front left perspective view of components of an exercise system in accordance with the invention installed in a door frame, with the door able to be closed. A detail portion "A" of this figure is shown in FIG. 2. A door frame includes two upright jambs [5] spaced apart to admit a door, and a lintel [6] which connects the tops of the jambs and strengthens the door frame. The exercise system is an apparatus including a pair of brackets, which are elongated frame elements [10] and [11] affixed to the two vertical jambs of a door frame, extending away from an operating door. The door has a width which relates to the spaced-apart distance between the brackets. The bars are designed to be easily removed and the permanently installed portions of the frame are unobtrusive, and the system as installed allows the door to open and close.

Each frame element includes a plurality of apertures [3] configured to receive a cross bar. Cross bars are available in various configurations adapted for different exercise tasks, play modes, and other functions. A cross bar has a length greater than the door width and is configured to be received in an aperture of a first one of the pair and a corresponding aperture in a second one of the pair of brackets, which lets both ends of an installed cross bar extend through and beyond the apertures in the spaced-apart brackets.

One class of cross bars [20] called a "swing bar" is adapted so that when installed it may rotate freely within the apertures of the frame elements supporting it, and these sorts of cross bars are used with swinging accessories and other play modes where the rotational degree of freedom is preferred or is necessary for the accessory to function. A cross bar for swinging accessories includes a laterally-extending apparatus connection facility [25] which in this embodiment shown is a rectangular flap appending from a medial portion of the bar and having a plurality of apertures for hanging swinging accessories. Another class of cross bars [30] is adapted to mechanically lock into at least one of the apertures of the frame elements which support it so that it resists rotation. This class of cross bars is often preferred for exercises such as pull-ups or chin-ups. According to a preferred installation, the sets of apertures on each frame element are registered with each other, so that when several cross bars are inserted spaced apart by the same number of apertures, the cross bars will reside parallel with each other. In the embodiment shown, a first cross bar is a swing bar having an apparatus connection facility and the other bar is a second bar free of an apparatus connection facility.

FIG. 2 shows an enlargement of the bounded portion "A" of FIG. 1. A swing bar [20] is received in an aperture of one of the two elongated frame elements which support it. The swing bar includes a laterally-extending apparatus connection facility [25] with a plurality of apertures for hanging swinging accessories, which will orient itself in a gravitationally "downward" direction while such accessories are hanging or swinging from it. The apertures [3] which receive and support the cross bars include a pocket [4] contiguous with the aperture and extending a limited partial depth into the frame element, so that a spring pin [21] or a rigid stud protruding from a cross bar not adapted for swinging may be received within the pocket to lock the bar from rotation. The spring pin is located along the length of the bar so that it is proximate to one end of the bar so that when it is installed it ends up proximate to one of the frame elements when the bar spans between the frame elements.

The brackets are flat, planar frame elements having a first, major face with apertures for receiving and supporting cross bars. The pockets are adjoined to the apertures and open to the major face defining them. Some apertures for receiving cross bars may not require a pocket if the installation location for a cross bar is not intended to preclude rotation of a cross bar, or if the corresponding, registered aperture on the other frame element includes such a pocket instead. In such an arrangement, a cross bar may be inserted with its spring pin adjacent the frame having the pocket for activities where the cross bar is intended to be rotationally locked, and the same cross bar may be removed and longitudinally reversed with the pin being adjacent to the other frame aperture lacking a pocket for other activities where the cross bar is intended for free rotation. According to another alternative embodiment within the scope of the invention, a bracket may be fashioned as an elongated frame element wherein each of the apertures on at least one of the frame elements has an associated pocket communicating with it.

Figure 3A:
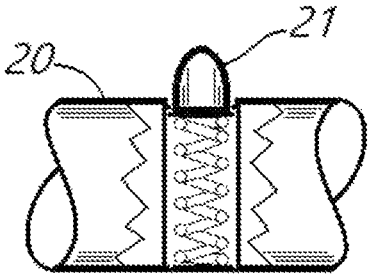
FIG. 3*a* shows a broken-out section view of a portion of a cross bar in accordance with the invention which includes a spring pin.

Many sorts of mechanical constructions may be incorporated into the invention to function as a "spring pin" as defined in this specification. FIG. 3*a* shows a broken-out section view of a portion of a cross bar [20] in accordance with the invention which includes a common type of spring pin protruding from the bar, which in the form shown includes a compressible element such as a helical spring contained within a tube, and a projecting, retractable stud [21] which projects beyond the outer diameter surface of the cross bar when extended. The stud may include a flange to keep it trapped within the tube, and its tip may be filleted or spherical or of an ogive as a lead-in when the bar is rotated so as to "click" into place in a pocket adjoining an aperture in the supporting frame element.

Figure 3B:
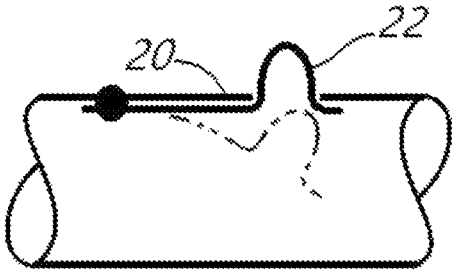
FIG. 3*b* shows a broken-out section view of a portion of a cross bar in accordance with the invention which includes an alternate embodiment of a spring pin.

FIG. 3*b* shows a broken-out section view of a portion of a cross bar [20] in accordance with the invention which includes an alternate embodiment of a spring pin as defined in this specification. In this embodiment the retractable component [22] protruding from the bar is a tip portion of a cantilevered spring beam with the other end of the cantilever anchored elsewhere within the bar, such as by a rivet or screw, or a hardware clip.

Figure 4:
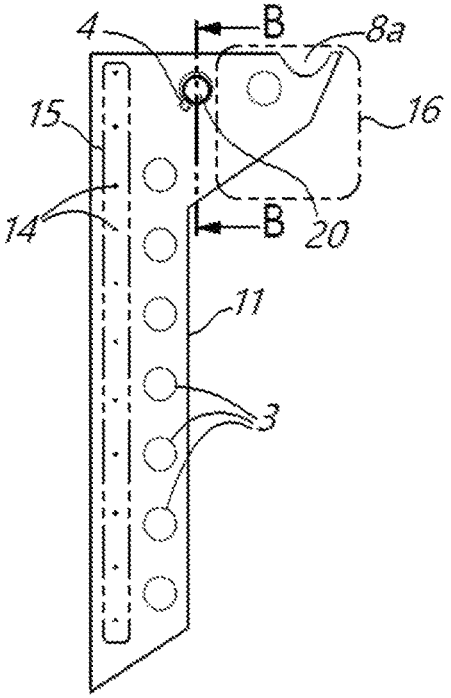
FIG. 4 shows a side view of a cross bar received by a door bracket, which is an elongated frame element in accordance with the invention, and defining section line "B-B" for the views of FIGS. 5*a* and 5*b*.
Figure 5A:
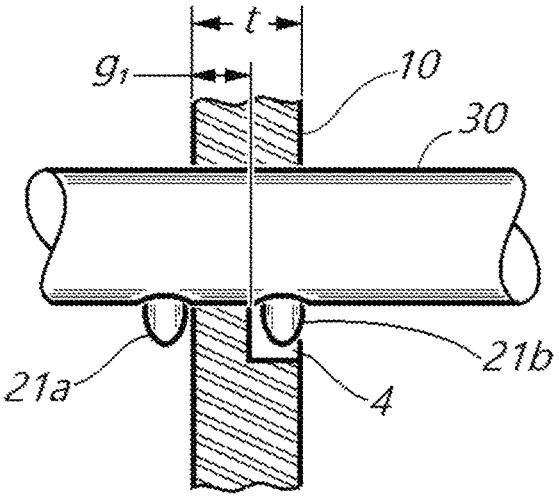
FIG. 5*a* shows a cross section of a portion of an elongated frame element of the invention taken at section line "B-B" of FIG. 4, with an aperture into which a portion of a cross bar is shown received.
Figure 5B:
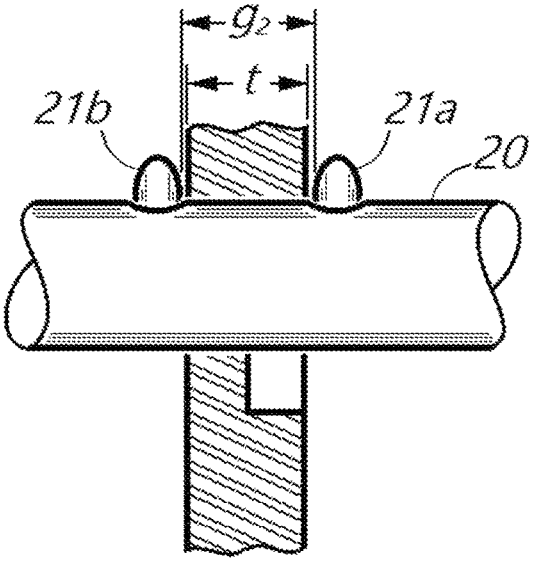
FIG. 5*b* shows a cross section of a portion of an elongated frame element of the invention taken at section line "B-B" of FIG. 4, with an aperture into which a portion of a cross bar of an alternate construction is shown received.

FIG. 4 shows a side view of a cross bar [20] received by a door bracket, which is an elongated frame element [11] in accordance with the invention, and defining section line "B-B" for the views of FIGS. 5*a* and 5*b*. Each frame element has an attachment portion [15] configured to be secured to a vertical portion of a door frame. In the embodiment shown, this attachment portion includes an array of apertures [14] designed to receive attachment hardware such as lag bolts, sheetmetal screws, or wood screws or similar hardware to secure the frame element to a doorjamb. It is also within the scope of the invention for this attachment portion to include surface textures providing additional frictional engagement with the mating surface of the door jamb or other attachment affordances, or to aid adhesion if adhesives are used to install the frame element.

So that cross bars may be set at various desired heights, each frame element of the exercise apparatus includes a plurality of the apertures [3] aligned in a single row. These rows of apertures of both brackets will register with each other when the brackets are installed in a door frame. According to a particular set of embodiments, one of the frame elements has such a plurality of apertures aligned in a single row, but these apertures lack the pin-receiving pockets described elsewhere in this specification, and according to another set of embodiments, only one from among the plurality of apertures includes such a pocket [4.] Another portion [16] of the frame element extends away from the attachment portion and includes its own aperture or apertures to accept a cross bar. The offset distance from the attachment portion allows a crossbar to be installed clear of the swept volume of the door so that the invention and its accessories may be used while the door is closed.

Because the frame elements are installed aside from the active passageway of the door, the frame elements may also include a hanging affordance [8*a*] which allows hanging accessories to be stowed aside from and out of the way of the doorway. The hanging affordances may also be located at an upper edge of the frame element so that crossbars and other accessories may be stored above and out of the way of the active passageway of the door. The hanging affordance shown may also serve as a hook for hanging a climbing rope or other flexible accessory to the side without having to uninstall the accessory completely, while making the door passageway visually and aesthetically available. Also, such an affordance for storing accessories at the extreme height of the frame element is desirable for accessories intended for use by adults and stored out of the reach of children.

FIG. 5*a* shows a cross section of a portion of an elongated frame element of the invention taken at section line "B-B" of FIG. 4, with an aperture into which a portion of a cross bar [30] is shown received. The cross bar in this figure includes two protrusions extending lateral to the axis of the cross bar. At least one of the two protrusions is a spring pin operable to retract in response to force, such that the spring pin engages a frame element to limit axial excursion of the bar in one direction, and the other pin, which may protrude rigidly or may be another retractable spring pin, limits the axial excursion of the bar in the opposite direction.

The type of cross bar shown in this figure is configured to be non-rotatable when installed in the frame element [10] as shown. The frame element has a thickness [t,] but the two spring pins are spaced apart from each other to define a gap [$g_1$] which is less than the thickness of the frame element. The frame element includes a pocket [4] contiguous with the aperture receiving the cross bar, and the pocket extends a limited partial depth into the frame element. The pocket is configured to receive the pin [21*b*] to prevent rotation of the bar, so that in cooperation with the pin [21*a*] residing on the other side of the frame element the cross bar as shown is locked against axial excursion and also locked against rotation, which is desirable from some exercises such as pull-ups or chin-ups. With one such frame element able to lock the cross bar, the apertures in the other frame element do not need corresponding pockets. The bar may be removed by depressing the spring pin to within the outside diameter of the cross bar so that the cross bar slides axially, in either direction, until either end of the cross bar comes free of the frame element. Although only one of the two pins may be a spring pin, it is preferable that the pin [21*a*] which is not received in the pocket be the retractable pin. It is also possible to have the cross bar with both pins being spring pins.

FIG. 5*b* shows a cross section of a portion of an elongated frame element of the invention taken at section line "B-B" of FIG. 4, with an aperture into which a portion of a cross bar [20] of an alternate construction is shown received. The frame element has a thickness [t,] but the two pins [21*a*] and [21*b*] are spaced apart from each other to define a gap [$g_2$] which is greater than the thickness of the frame element, and this type of bar is also called a swing bar. In a preferable embodiment the spacing between the pins is only slightly greater than the thickness of the frame element so that the bar is closely received within the frame element and substantially constrained from axial excursion. The swing bar is rotatable within its aperture in the frame element. For swinging motions it is preferable that the pins be located so that they do not encounter a pocket appended to the aperture. Also, although it is possible to rotate the bar pin and slide it axially for a pin to dwell in the pocket, this condition is not positively locked against rotation. Some accessories may be retained or stowed in this condition although axial motion of the cross bar will release it from its rotational constraint.

Figure 6A:
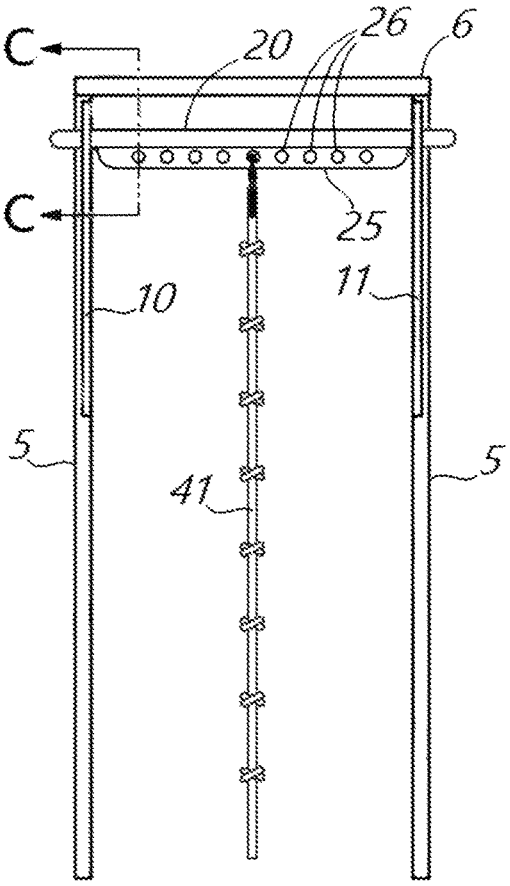
FIG. 6*a* shows a door frame with a pair of elongated frame elements installed and a cross bar adapted for attaching swingable accessories and in this instance supporting a play rope having spaced-apart knots for climbing and swinging. Section line "C-C" is included for the views of FIGS. 6*d* and 6*e*.

FIG. 6*a* shows a door frame with a pair of elongated frame elements [10] and [11] installed in door jambs [5] and a cross bar [20] which is a swing bar adapted for attaching swingable accessories. Section line "C-C" is included for the views of FIGS. 6*d* and 6*e*. In this embodiment the swing bar includes a laterally-extending apparatus connection facility [25] supporting a play rope [41] having spaced-apart knots for climbing and swinging. The lintel [6] of the door frame substantially increases the strength of the door frame for supporting the forces of various exercise and play activities. The apparatus connection facility in this embodiment is a planar member located at an intermediate portion of the bar and perforated by a linear array of apertures [26.]

Figure 6B:
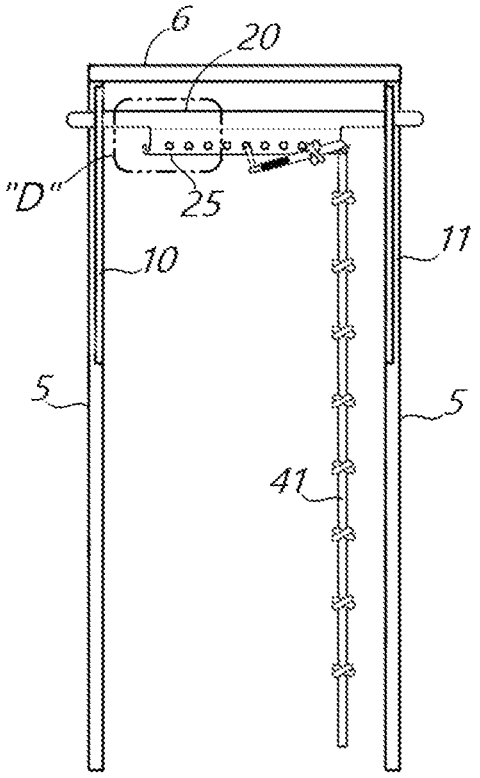
FIG. 6*b* shows the door frame, cross bar, and play rope of FIG. 6*a*, but with the play rope stored aside the central passage of the door frame. A detail portion "D" of this figure is shown in FIG. 6*c*.
Figure 6C:
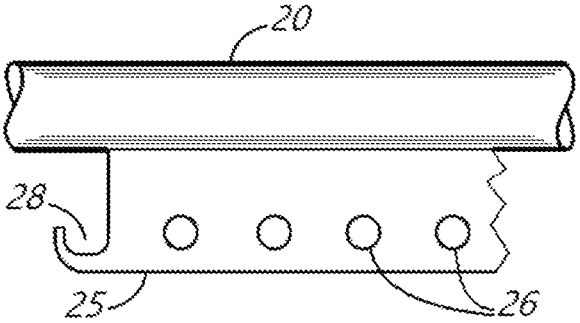
FIG. 6*c* shows a detail view of an apparatus connection facility portion of a swing bar shown in FIG. 6*b*.

FIG. 6*b* shows the door frame [5, 6,] cross bar [20,] and play rope [41] of FIG. 6*a*, but with the play rope stored aside the central passage of the door frame A detail portion "D" of this figure is shown in FIG. 6*c*. Axially constrained by the pins and spring pins, the cross bar or swing bar passes through both supporting frame elements [10, 11,] and its ends extend wider than the width of the door and wider than the spaced-apart distance of the frame elements so the risk of a bar sliding out of a support during use is minimized.

FIG. 6*c* shows a detail view of an apparatus connection facility portion [25] of a swing bar [20] shown in FIG. 6*b*. The apparatus connection facility is a linear array of apertures [26] for receiving and retaining snap-in or tie-in accessories such as climbing ropes, rope swings and ladders, pull-up rings, or suspended play objects such as punching bags or game targets. In this particular embodiment of an apparatus connection facility, one or both ends of a perforated planar member include a hook [28] as a hanging affordance. The hanging affordance shown acts as a hook for hanging a centrally attached climbing rope or other flexible accessory to the side without having to uninstall the swing bar completely, thus making a substantial portion of the door passageway visually and aesthetically available.

Figure 6D:
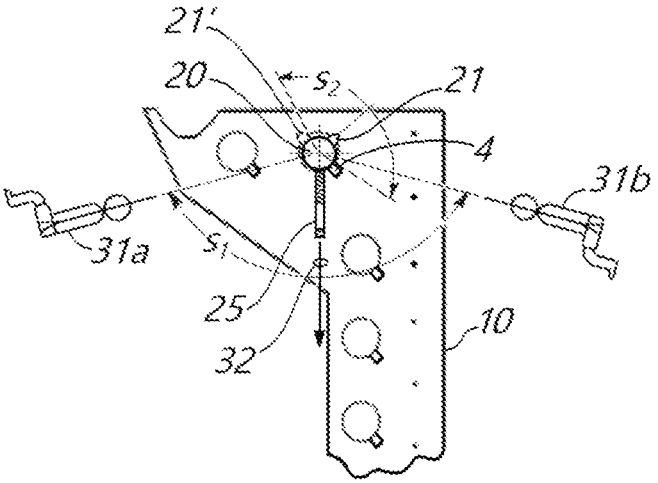
FIG. 6*d* shows a cross section of portions of a cross bar and an elongated frame element taken at section line "C-C" of FIG. 6*a*, with apertures for supporting a cross bar shown in a position allowing free rotation for swinging.

FIG. 6*d* shows a cross section of portions of a cross bar [20] which is a swing bar, and an elongated frame element, taken [10] at section line "C-C" of FIG. 6*a*, with apertures for supporting the swing bar shown in a position allowing free rotation for swinging. As seen in this figure, the spring pin [21] is angularly located with respect to the connection facility plate so that while within a sweep angle [$s_1$] of rotation typical for swinging, the pin is oriented away from the pocket so that does not encounter the pocket and does not rotationally lock the swing bar. A conservatively extreme angle for active swinging is shown spanning between the stylized swinging figures [31*a*] and [31*b*,] each of which is about 75° away from a downward vertical rest position indicated by arrow [32.] The swing bar includes a laterally-extending apparatus connection facility [25] extending away from the rotational axis of the bar, such that tension on the connection facility perpendicular to the axis establishes a rotational position of the bar. As seen in the figure, when the apparatus connection facility extends in a downward direction, a spring pin [21] on the bar and a pocket [4] on the frame element are rotationally misaligned to prevent the spring pin from engaging the pocket during its angular excursion [$s_2$] while swinging. According to a preferred embodiment, when the apparatus connection facility extends downward, the pin and the pocket are rotationally offset by at least 90 degrees. According to an alternative embodiment, when the apparatus connection facility extends downward, the pin [21'] and the pocket are rotationally offset by 180 degrees.

Figure 6E:
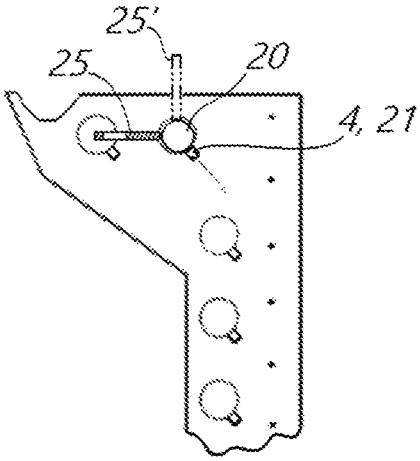
FIG. 6*e* shows the portion of the elongated frame element and the cross bar of FIG. 6*d* taken at section line "C-C" of FIG. 6*a*, but with the cross bar shown in a storage position and in an alternate storage position.

FIG. 6*e* shows the portion of the elongated frame element and the swing bar [20] of FIG. 6*d* taken at section line "C-C" of FIG. 6*a*, but with the swing bar shown in a storage position and in an alternate storage position. As described previously, although not positively locked from rotation, a swing bar may be rotated so that its pin [21] aligns with a pocket [4] communicating with the aperture in the frame element through which the bar passes. Then the bar may be slid axially to insert the pin into the pocket so that the swing bar would be lightly retained in a storage position with its apparatus connection facility [25] residing up out of the way of the door passageway and roughly parallel to the floor. According to an alternative embodiment orienting the pin an additional 90° away from the location depicted in this figure, the storage position of the apparatus connection facility may extend vertically upward, or nearly so, as shown by [25'.] The non-locking behavior of the spring pins shown in FIGS. 6*d* and 6*e* also operate similarly with non-retractable, rigid pins which may also be oriented to avoid being received in a pocket during swinging of a swing bar.

Figure 7:
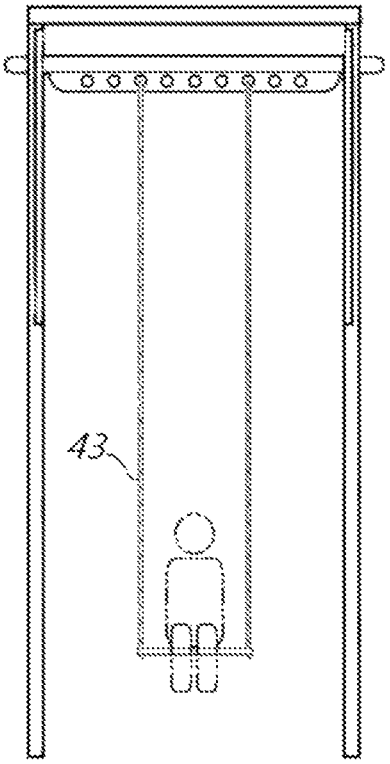
FIG. 7 shows a pair of elongated frame elements in accordance with the invention installed in a door frame, and a cross bar adapted for swinging supporting a rope swing.

FIG. 7 shows a pair of elongated frame elements in accordance with the invention installed in a door frame, and a cross bar adapted for swinging supporting a swing [43] configured for attachment to the apparatus connection facility. It is known that having children play on or in swings promotes movement and perceptual skills, spatial awareness, general fitness, social interaction, mental representation, and sensory integration, including vestibular development (balance.)

Suitable materials for the brackets include polyvinylchloride (PVC) and a suitable material thickness for the brackets or elongated frame elements may be ⅜" thick. PVC is lubricious and compatible with many sorts of bar materials such as wood or metals, and exhibits good tribology as a journal bearing material for cross bars. Another suitable material offering low friction and acceptable wear life is an acetal homopolymer called Polyoxymethylene (POM) such as Delrin®.

Although many exemplary embodiments are described above, it will be appreciated that the invention is intended to cover all modifications and equivalents within the scope of the following claims.

I claim:

1. An exercise apparatus comprising:

a pair of elongated frame elements;

each of the pair of elongated frame elements defining a plurality of apertures configured to receive a cross bar;

each of the pair of elongated frame elements having an attachment portion configured to be secured to a vertical portion of a door frame away from an operating door having a door width;

a cross bar having a length greater than the door width and configured to be received in a pair of apertures of the plurality of apertures of the pair of elongated frame members;

a protrusion directly attached to the crossbar and configured to limit the position of the cross bar with respect to at least one of the pair of elongated frame elements; and wherein the protrusion on the cross bar is a spring pin protruding from the cross bar and operable to retract in response to force, such that the spring pin engages a frame element of the pair of elongated frame elements to limit axial excursion of the cross bar.

2. The exercise apparatus of claim 1 wherein the cross bar has a laterally-extending apparatus connection facility located at an intermediate portion of the cross bar, and away from the axis of the cross bar, such that tension on the laterally-extending apparatus connection facility perpendicular to the axis establishes a rotational position of the cross bar.

3. The exercise apparatus of claim 2 wherein when the laterally-extending apparatus connection facility extends in a downward direction, a spring pin on the cross bar and a pocket on the pair of elongated frame elements are rotationally misaligned to prevent the spring pin from engaging the pocket.

4. The exercise apparatus of claim 3 wherein when the laterally-extending apparatus connection facility extends downward, the spring pin and the pocket are rotationally offset by at least 90 degrees.

5. The exercise apparatus of claim 3 wherein when the laterally-extending apparatus connection facility extends downward, the spring pin and the pocket are rotationally offset by 180 degrees.

6. The exercise apparatus of claim 2 including an additional spring pin, wherein the spring pins are spaced apart from each other to define a gap greater than a thickness of one of the pair of elongated frame elements.

7. The exercise apparatus of claim 2 including a second bar free of a laterally-extending apparatus connection facility, and having two spring pins spaced apart by less than the thickness of one of the pair of elongated frame elements.

8. The exercise apparatus of claim 2 including a swing configured for attachment to the laterally-extending apparatus connection facility.

9. The exercise apparatus of claim 1 wherein a frame element of the pair of elongated frame elements has a first major face defining a pocket contiguous with at least one of the plurality of apertures configured to receive a cross bar and extending a limited partial depth into the frame element of the pair of elongated frame elements.

10. The exercise apparatus of claim 9 wherein the pocket is configured to receive the spring pin to prevent rotation of the cross bar.

11. The exercise apparatus of claim 9 wherein each of the plurality of apertures on at least one of the pair of elongated frame elements has an associated pocket.

12. The exercise apparatus of claim 9 wherein only one of the pair of elongated frame elements includes the pocket.

13. The exercise apparatus of claim 1 including an additional spring pin, wherein the spring pins are spaced apart from each other to define a gap.

14. The exercise apparatus of claim 13 wherein the gap is less than a thickness of a frame element of the pair of elongated frame elements.

15. The exercise apparatus of claim 13 wherein the gap is greater than a thickness of a frame element of the pair of elongated frame elements by a limited amount such that one of the pair of elongated frame elements is received in the gap.

16. The exercise apparatus of claim 1 wherein the spring pin is proximate one end of the cross bar such that it is proximate one of the pair of elongated frame elements when the cross bar spans between the pair of elongated frame elements.

17. The exercise apparatus of claim 1 wherein the plurality of apertures configured to receive a cross bar in each pair of elongated frame elements is in a single row.

18. The exercise apparatus of claim 1 wherein the plurality of apertures configured to receive a cross bar on each pair of elongated frame elements are registered with each other.

* * * * *